United States Patent [19]

May

[11] 4,009,034

[45] Feb. 22, 1977

[54] DRY FILM PROCESSING

[75] Inventor: Joseph N. May, Webster, N.Y.

[73] Assignee: Xerox Corporation, Stamford, Conn.

[22] Filed: Feb. 18, 1975

[21] Appl. No.: 550,302

Related U.S. Application Data

[62] Division of Ser. No. 377,887, July 9, 1973, Pat. No. 3,902,041.

[52] U.S. Cl. ..... 96/48 HD; 96/63; 96/114.1

[51] Int. Cl.[2] ..... G03C 5/24; G03C 1/02

[58] Field of Search ..... 96/66 T, 48 HD, 63, 96/114.1; 354/299; 219/216

[56] References Cited

UNITED STATES PATENTS

| | | | |
|---|---|---|---|
| 2,971,840 | 2/1961 | Haydn | 96/66 T |
| 3,212,896 | 10/1965 | Yudelson et al. | 96/63 |
| 3,260,603 | 7/1966 | Reitter | 96/48 HD |
| 3,377,165 | 4/1968 | Workman | 96/48 HD |
| 3,648,019 | 3/1972 | Brewitz | 219/216 |
| 3,826,896 | 7/1974 | Thompson | 354/299 |
| 3,832,186 | 8/1974 | Masuda et al. | 96/114.1 |

*Primary Examiner*—Mary F. Kelley
*Attorney, Agent, or Firm*—Robert J. Bird

[57] ABSTRACT

Method and apparatus for processing dry film. The non-emulsion side of the film is placed in contact with a plate surface that is at or above the developing threshold potential of the film. A second heated plate surface, at the same temperature as the first plate surface, is placed in close non-contiguous relation with the exposed emulsion side of the film whereby the film is heated under adiabatic conditions during processing. The film is removed from the developing region and allowed to cool in air.

3 Claims, 1 Drawing Figure

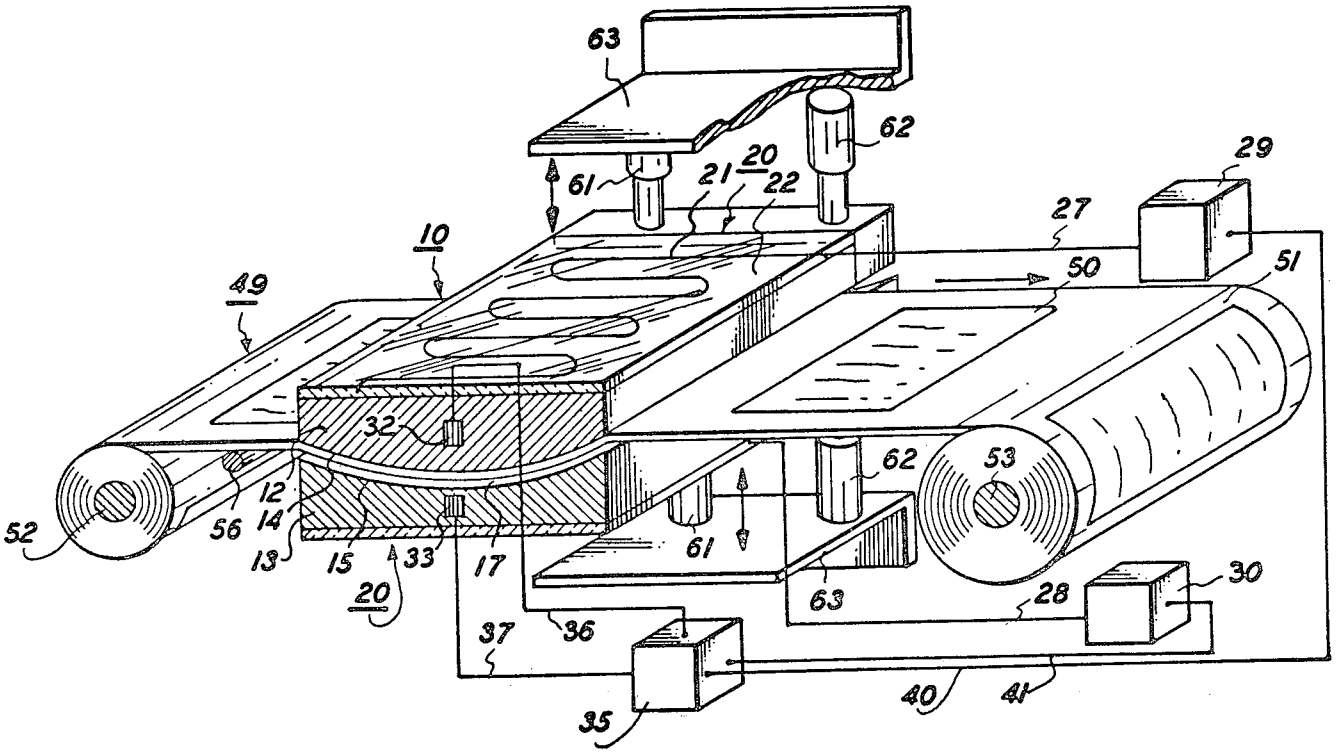
29
51
30
27
50
28
41
53
40
62
62
63
20
22
21
61
63
61
35
36
17
37
10
33
32
20
15
12
14
13
49
56
52

DRY FILM PROCESSING

This is a division of my copending application Ser. No. 377,887, filed July 9, 1973 now U.S. Pat. No. 3,902,041, issued Aug. 26, 1975.

This invention relates to method and apparatus for processing heat sensitive film.

In recent years, a new type of heat processable film has been developed wherein, images recorded on the film, can be developed and fixed by heating the film to or above its threshold temperature and then cooling the film to ambient temperatures. This film is generally referred to as "dry film" and is typified by a film produced by the Minnesota, Mining and Manufacturing Company of St. Paul, Minnesota and consists of a dry silver halide emulsion which is placed upon a polymer support surface. For further information concerning this dry film, reference is had to U.S. Pat. No. 3,457,075.

The use of this dry film, particularly in automatic processing equipment, has heretofore found only limited usage primarily because of problems relating to the heat developing process. The most dependable system for developing this film heretofore known in the art involves drawing the imaged film through a heated bath of non-wetting liquid to accomplish development. However, as such, this liquid system has all the objectionable drawbacks associated with a wet film processing system, particularly employed in an automatic environment, and thus defeats many of the advantages associated with the dry process. Other non-liquid heating systems, including hot platens, radiant ovens and the like have also been tried with varying degrees of success in the processing of dry film but these systems all have been found objectionable primarily due to the fact that a uniformity in development has oftentimes been difficult or even impossible to maintain.

It is therefore an object of the present invention to improve the processing of dry film.

A further object of the present invention is to provide method and apparatus for automatically processing dry film.

A still further object of the present invention is to improve the uniformity of development of a dry process image recording medium.

These and other objects of the present invention are attained by means of an adiabatic heating process wherein complementary surfaces upon two blocks or plates are placed in close proximity with each other to form a relatively enclosed cavity in which the dry film is processed. The non-emulsion side of the film is placed in direct contact with one of the plate surfaces forming the cavity while the exposed or image bearing emulsion side of the film is held in close non-contiguous relation with the other surface making up the cavity. The plates are then both heated to the same uniform temperature, preferably somewhat above the development threshold temperature of the film, and the film is held within the cavity for a period of time sufficient to develop images recorded thereon. The film is removed from the cavity and cooled to ambient temperatures to accomplish fixing.

For a better understanding of the invention as well as other objects and further features thereof reference is had to the following detailed description of the invention to be read in connection with the accompanying drawing which represents a perspective view illustrating an adiabatic heating cavity embodying the teachings of the present invention.

As exemplified by U.S. Pat. No. 3,608,466, most thermal systems for processing dry film that are in use today involve a conductive heat transfer mechanism in which the exposed film is held in intimate contact against the surface of a heated platen. As described in the above-noted patent, one side of the film is placed in intimate physical contact with the heated platen surface with the heat energy passing through the film and being discharged into a heat sink positioned on the opposite side of the film. The heat sink can take any form ranging from an insulating backing member to the surrounding atmosphere. As such, the heat flux established between the isothermal boundaries of the system can be influenced by many different uncontrollable variables which lead to undesirable development. For example, if a small particle of foreign matter, such as random dirt or lint, is deposited upon the platen surface, the contaminate will act to reshape or otherwise influence the flux network in a localized region which will, in turn, produce non-uniform development within the contaminated regions. This type of defect generally manifests itself as a "halo" which is recorded upon the process film. Similarly, any changes in the heat transfer characteristics of the heat sink or backing member which is induced by means or convection or the like, will also effect the heat transfer geometry of the system and produce non-uniform development.

Heretofore, most efforts directed at correcting a platen type development system were directed solely towards producing a more positive contact between the heated platen surface and the exposed film in process.

The present invention herein utilizes the heated platen development technique but represents a radical departure from most approaches known and used in the art for producing uniformity of development. The present system relies upon a conductive mechanism in the transient state, i.e. when a film is being raised to the process temperature of an adiabatic condition (net heat flux through film = 0) in the steady state. By use of the adiabatic system in conjunction with heated platens, an extremely rapid, efficient and uniform heating of the exposed film is produced. By combining these two features, a developing system can be constructed which has a much wider developing latitude than those presently known and used in the art. Furthermore, the present system does not demand that complete intimate contact be maintained between the film and the platen and can also tolerate a normal amount of contamination within the development zone while delivering repeatable uniform development.

Referring now to the drawing, the development station 10 of the present invention is made up of two vertically spaced blocks or plates 12, 13 which are preferably constructed of a material having a high coefficient of thermal conductivity. In practice, the plates can be fabricated of aluminum, copper or any other suitable material exhibiting the heretofore mentioned characteristics. The upper plate 12 is provided with a generally convex shaped working surface 14 for contacting the back side or the non-emulsion side of the film. The lower plate 13 is similarly provided with a concave working surface 15 that complements the working surface upon the upper plate. In assembly, the plates are mounted with the two working surfaces being adjacent to but in non-contiguous relation with each other to provide a horizontally extended cavity 17 therebetween which defines the development zone of the system.

On the outer surface of each plate, that is, the surface opposite the working surfaces, there is placed a foil heating blanket 20 which provides heat energy to the system. The blankets are both formed of a ribbon type resistance heating element 21 which is preferably sandwiched between two relatively thin sheets of plastic electrical insulating material 22. Blankets similar to the one herein described are commercially available from a number of suppliers including the Rodger's Corp. of Willimantic, Conn. Alternatively, the ribbon type heating element can be bonded directly to the outer surface of the two plates directly above the developing cavity and an insulating material placed directly over the heating element.

The terminal ends of each blanket are brought out, via lines 27, 38 to two variable power supplies, an upper blanket power supply 29 and a lower blanket power supply 30, which provide input energy to the heaters. Because of the high thermal conductivity of the plates, the energy delivered to the heaters is rapidly and efficiently passed through the plates to bring the working surface 14 and 15 thereon to a predetermined operating temperature that is at or above the development threshold temperature of the film in process.

In order to obtain truly uniform development of high density images, it is extremely important that the working surfaces of the two plates forming the development cavity be maintained at the same temperature. A pair of temperature sensors 32 and 33 are embedded within the two plates with the sensing elements thereon arranged to detect the temperature of the plates close to the working surfaces thereon. The sensors are both electrically connected to a comparator circuit 35 via lines 36 and 37 which is capable of determining any deviation between the temperature sensed and the desired development temperature. When the comparator circuit detects that the temperature of either plate has fallen above or below the desired operating temperature, a corrective signal is generated by the comparator circuit and sent to the appropriate power supply unit by means of lines 40 or 41. In response to the corrective signal the output of the appropriate power supply is adjusted thus bringing the system back within optimum operating conditions.

In the preferred embodiment of the present invention it is contemplated that a series of exposures that are stored upon a web 49 are to be processed. However, it should be clear to one skilled in the art that the teachings of the present invention are not so limited and that the development system herein disclosed can process cut strips of film equally as well without departing from the teachings of the present invention. The web in process consists of a series of exposed frames 50 containing input scene information recorded on the emulsion side of the film with the frames being separated by a strip 51 of unexposed film. The web is carried upon a supply spool 52 and is brought emulsion side down through the developing cavity and secured to a take up spool 53. Although not shown in the drawing, an indexing drive is operatively connected to the take up spool which is adapted to advance, upon demand, the web one frame at a time. The developing station 10 is located in reference to the take up spool so that the frame recorded on the web is centered within the developing cavity each time that the web is so indexed. A web tensioning means, such as tensioning roll 56, is provided to place a predetermined amount of tension upon the web as it is being processed with the developing zone.

To facilitate the positioning of the exposed frames within the developing cavity, the two adiabatic heating plates are both arranged to move vertically between an operative or developing position to a second more extended open position. Prior to the indexing of each frame into the developing cavity, the plates are moved to the open position. Once the web has been indexed, the cavity is closed thereby bringing the upper working surface of plate 12 into pressure contact against the non-emulsion side or support surface of the film. The distance between the two plate working surfaces, when the plates are in the closed or operative position, are such that the working surface of the lower plate 13 is in relatively close non-contiguous relation with the exposed emulsion side of the film. Although, because of the adiabatic heating mechanism herein utilized, the distance between the two plate working surfaces is not critical, it is, however, preferred that the distance across the cavity be approximately between 2½ and 5 times the thickness of the film in process. The size cavity when in an operative or developing condition, however, should be small enough to impede the introduction of unwanted convective air flow currents through the development zone during film processing.

A hydraulically actuated lifting mechanism is herein provided to facilitate movement of the plates in a vertical direction. At the outboard ends of each plate is secured end blocks 60 constructed of a phenolic material, or any other suitable material exhibiting good heat insulating properties, to which a pair of hydrial lifting cylinders 61 and 62 are secured. The phenolic end blocks provide a support surface against which the hydraulic cylinders act and also provides a thermal insulating barrier which serves to hold heat energy within the boundaries of the developing system. Although not shown, similar heat barriers can also be positioned along the side walls of the plate to further reduce unwanted heat losses from the system. The opposite ends of the hydraulic cylinders are secured to a mounting plate 63 which is affixed, as for example by welding, to a support frame (not shown). A piston, which is located within each cylinder, is arranged to be hydraulically moved between two extreme positions which, in turn, causes the plates to move in the direction indicated between a fully opened and a fully closed position. The hydraulic control system can be operatively associated with the web indexing mechanism by any suitable means known and used in the art to automatically coordinate the opening and closing of the developing cavity with the movement of exposed frames into and out of the development zone.

Dry silver halide film similar to that disclosed in the previously noted U.S. Pat. No. 3,457,075 has been processed using the apparatus herein disclosed to obtain consistently uniformly developed images. Basically, the film process had a cross-sectional dimension of about 0.004 inches and a rapid development threshold temperature of approximately 225° F. The film was processed within a cavity formed between the working surfaces of two heated plates maintained a distance of between 0.010 and 0.020 inches apart. The non-emulsion side of the film was held against the convex working surface of one of the plates with a tension of between 2 and 4 pounds. The plates were heated in the manner herein described whereby the working surfaces of the plates were uniformly heated to about 60° F above the developing threshold temperature of the film. The exposed film was held in the cavity for between 6 and 10 seconds and then cooled in air. Uniformly developed images within a density range of 1.6 and 1.8 were repeatably processed.

While this invention has been described with reference to the structure herein disclosed, the present invention is not confined to the specific details set forth and this application is intended to cover any modifications or changes that may come within the scope of the following claims.

What is claimed is:

1. A process for developing a discrete area of an extended exposed dry film having a heat developable emulsion placed upon a support material including the following steps in sequence:

a. positioning said discrete area of the support side of said film in tension and in contact with a convex surface of a first heating element, said convex surface disposed in spaced face-to-face relationship with a concave surface of a second heating element to define therewith a developing cavity, b. effecting relative movement of said heating elements in a direction to narrow said cavity and to place the exposed emulsion side of said film into close non-contiguous relationship to said concave surface, and c. heating said first and second heating elements substantially uniformly and to substantially the same temperature at or above the threshold developing temperature of said film, whereby the image on said film is fixed in accordance with the pattern created during its exposure

2. A process for developing a discrete area of an extended exposed dry film as defined in claim 1 and further including the following steps in sequence:

d. effecting relative movement of said heating elements in the opposite direction to open said cavity, e. repeating step (a) for the next discrete area of said film, and f. repeating steps (b), (c), and (d).

3. A process for developing a discrete area of an extended exposed dry film as defined in claim 2 and further including the following steps:

g. repeating steps (e) and (f) in a continuous, stepped sequential mode of film development.

* * * * *